US006915590B2

(12) United States Patent
Chillington

(10) Patent No.: US 6,915,590 B2
(45) Date of Patent: Jul. 12, 2005

(54) TOOL KIT FOR INSTALLING ROOFING OR SIDING MATERIALS

(75) Inventor: James Chillington, Stamford, CT (US)

(73) Assignee: Chillington Tool Co., Inc., Stamford, CT (US)

( * ) Notice: Subject to any disclaimer, the term of this patent is extended or adjusted under 35 U.S.C. 154(b) by 0 days.

(21) Appl. No.: 10/434,039

(22) Filed: May 8, 2003

(65) Prior Publication Data

US 2004/0221467 A1 Nov. 11, 2004

(51) Int. Cl.[7] ..... G01D 21/00
(52) U.S. Cl. ..... 33/649; 33/648
(58) Field of Search ..... 33/648–649, 452, 33/459, 456, 463, 411, 613, 645

(56) References Cited

U.S. PATENT DOCUMENTS

| | | | | | |
|---|---|---|---|---|---|
| 253,816 | A | * | 2/1882 | Clark | 33/648 |
| 738,256 | A | * | 9/1903 | Tinklepaugh | 33/648 |
| 1,989,141 | A | * | 1/1935 | Leonard | 33/648 |
| 2,889,632 | A | * | 6/1959 | Longhi | 33/648 |
| 4,473,100 | A | * | 9/1984 | Wheeler | 81/45 |
| 4,484,392 | A | * | 11/1984 | DeFino et al. | 33/647 |
| 4,785,606 | A | | 11/1988 | Burton | |
| 4,860,518 | A | | 8/1989 | Kingham | |
| 5,205,103 | A | | 4/1993 | Burton | |
| 5,311,670 | A | | 5/1994 | Tomoiaga | |
| 5,526,577 | A | | 6/1996 | Nix | |
| 5,918,439 | A | | 7/1999 | Metzer et al. | |
| 6,470,646 | B1 | | 10/2002 | Bryant | |
| 6,705,021 | B2 | * | 3/2004 | Nadal et al. | 33/647 |

* cited by examiner

*Primary Examiner*—Christopher W. Fulton
*Assistant Examiner*—Tania Courson
(74) *Attorney, Agent, or Firm*—Gottlieb Rackman & Reisman PC

(57) ABSTRACT

A tool for laying sequential courses of tiles on an inclined roof, or sidewall the tool including a rail and several arms sized to extend over a previous course of tiles and to position the rail to define a straight edge for the current or new tile course. The arms extend over the current course and their ends are nailed or otherwise secured to the roof or sidewall. After the course is laid, the rail is moved up for the next course. A kit is formed of one or more rails, sets of arms, each set being sized and/or hinged for a corresponding type of tile, and means of interconnecting and aligning the rails. Two rails may also be used to provide roofing on a roof having two sections joined by a valley. For this configuration, a curved, flexible connector is used which is formed of a rubber pipe.

1 Claim, 12 Drawing Sheets

260
262
264
266
268
270
272
274
274A
276
278
280
282
284
286
288
290
292
294
295
296
297
298
12

250
12
300
250'

302

296
298
268
294
304
296

306
268
12
264

TOOL KIT FOR INSTALLING ROOFING OR SIDING MATERIALS

RELATED APPLICATIONS

None

BACKGROUND OF THE INVENTION a. Field of Invention

This invention pertains to a tool kit used during the installation of roofing tiles, shingles or other similar materials. The tool is used to lay a whole or partial course of tiles on alignment and then affixing the tiles to the roof. The tool kit may also be used to install exterior materials such as siding.

b. Description of the Prior Art

The act of laying tiles or shingles on a slanted roof is still a manual operation that is time consuming and labor intensive. Typically, a roofer places each tile on the roof and nails it before laying then next tile. Since the roof is slanted, during this operation, the tile must be hand-held to insure that it does not slip off and break, and/or injure a bystander.

Attempts have been made in the past to provide tools that can assist in this process, or even automate the process. Attempts have also been made to provide a tool useful for aligning the roofing tiles. Some samples of these prior art designs are found in the following patents:

U.S. Pat. Nos. 1,380,485
3,842,934
4,785,606
4,860,518
5,205,103
5,311,670
5,526,577
5,918,439

However, none of these patents provide a satisfactory and inexpensive solution to the problems.

SUMMARY OF THE INVENTION

Thus there is a present need for a simple, easy to use tool that can be used to install a plurality of roofing tiles (or other similar roofing materials) quickly and easily. Preferably this tool should also be capable of aligning the tiles. Once a course, or a portion of a course is laid, it is desirable that the tool be easily removed. Moreover, it is also desirable to have a tool that can be expanded to install tiles on two roofing surfaces in a single operation wherein the roofing surfaces form an interior angle.

Briefly, a roofing tool for laying courses of roofing tiles on a roof includes a rail defining a straight edge for aligning the tiles of a course; and a plurality of arms extending perpendicularly upwardly of said rail and attached thereto, each said arm having a length exceeding by a predetermined amount the length of the tiles of the respective course, said arms being constructed and arranged to support said rail on the roof. Preferably, the arms have a length of about 4–18 in above the lengths of the tiles. Each said arm has a lower portion with an end attached to the rail and a length approximately equal to the lengths of the respective tiles. Each arm also has an upper portion colinear and laterally offset from said lower portion, said upper portion including securing means, such as one or more holes, for securing said arms to the roof. The arms have one end attached to said rail.

In one embodiment, the arms and the rail are coupled by a joint that allows said arms to move longitudinally along said arm.

In another aspect of the invention, a plurality of joints are provided, each joint connecting one of said arms to said rail, wherein said arms are slidable with respect to said rail. Preferably, the joints allow the arms to pivot with respect to the rail for easy storage.

A skirt is attached to and extending substantially along the length of the rail to provide cushioning as each tile is installed.

Another aspect of the invention pertains to a roofing tool kit for installing several types of tiles in courses on a roof with a roofing deck, each type of tile having a different dimension. The kit includes a rail adapted to define straight edges for said courses; a plurality of sets of arms, each set of arms being sized to fit over a corresponding type of tile; and a plurality of knobs for coupling one of said sets of arms to said rail in a spaced relation along said rail, said rail and said one of said sets of arms cooperating to position said rail along a previous course of tiles and to define a straight edge for a present course of tiles with said arms extending from said rail, over said present course of tiles and terminating with an end just beyond said present course of tiles said termination being secured to the roof decking.

Preferably, the knobs are constructed and arranged to pivotably mount said arms on said rail. A slider may be provided for selectively coupling said rails in a colinear relationship. Alternatively, a connector for connecting said rails at an angle to each other. The connector includes a skirt for cushioning the tiles.

The tool kit may be used to install other exterior coverings, such as shingles and other similar siding material.

DETAILED DESCRIPTION OF THE INVENTION

Figure 1:
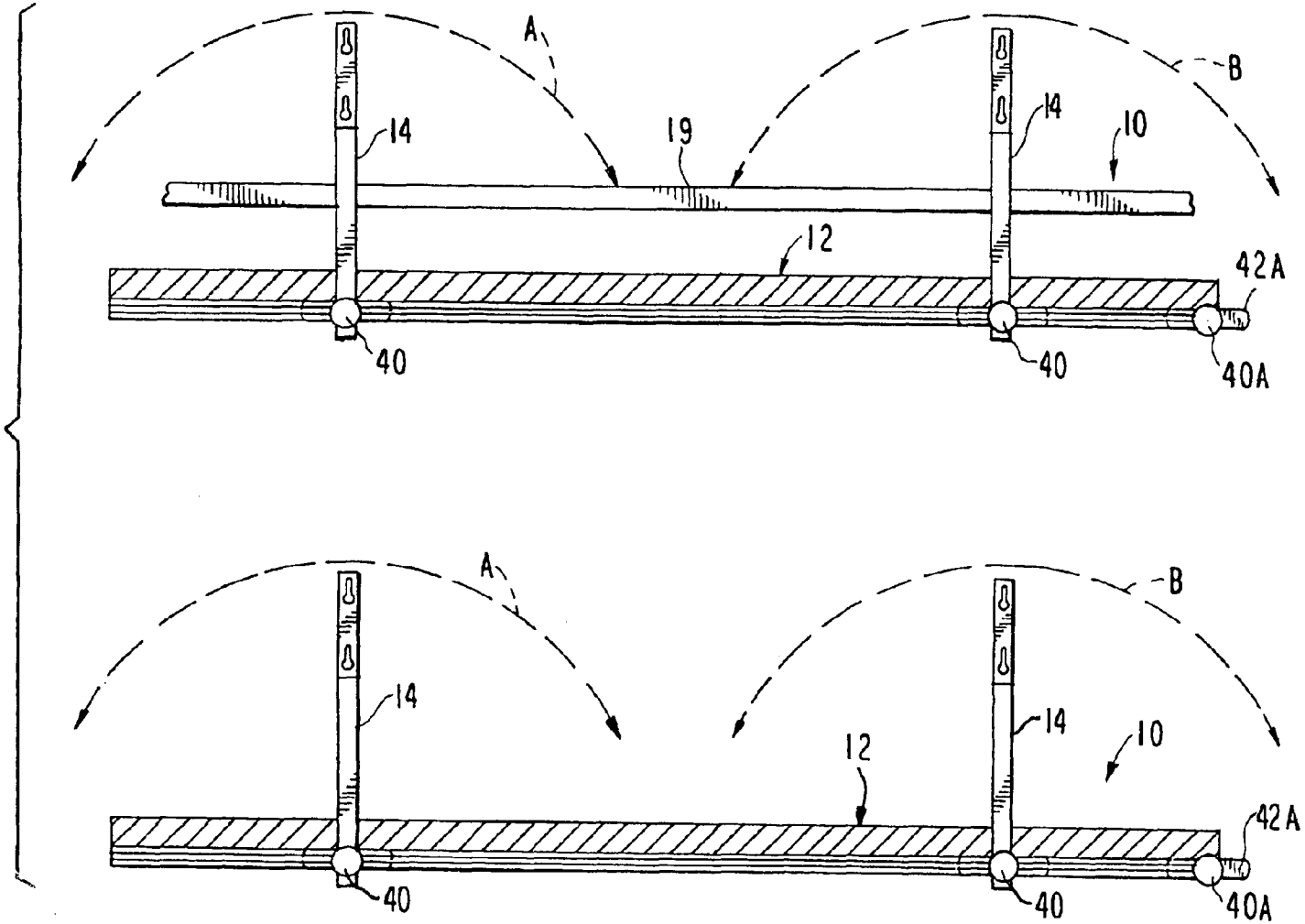
FIG. 1 shows a plan view of a roofing tool constructed in accordance with this invention.

The roofing tool described below is useful for installing tiles on a slanted roof. The term 'tile' is used to any suitable roofing material, such as clay tiles, slate tiles, wood shingles, Spanish tiles (having curved or wavy cross-section), etc.

Referring first to FIGS. 1–5, a roofing tool 10 constructed in accordance with invention includes a rail 12 and a plurality of arms 14. Preferably the rail 12 consists of a channel 16 with a hollow passage 18 and a longitudinal slot 20. In a lower section of the channel 16 there is provided a secondary longitudinal passage 22. Attached to rail 12 is a skirt 24 consisting of a web 26 and collar 28. The collar 28 is sized and shaped to fit into the secondary passage 22. To reduce its weight, the channel 16 can shaped to fit into the secondary passage 22. To reduce its weight, the channel 16 can be made with a through hole 30.

Rail 12 can be made to be about 4–8 feet long. The channel 16 can be made of a metal such as aluminum or an aluminum alloy and can be extruded. The channel could be about 1 in wide and 1 in thick.

The skirt 24 attached to the channel 16 can be made of rubber or other flexible material. The web is preferably about 2" wide. Its collar 28 fits into and is captured by the secondary channel 22 (using an interference fit or an adhesive) so that it does not move or slide longitudinally with respect to the channel.

Figure 2:
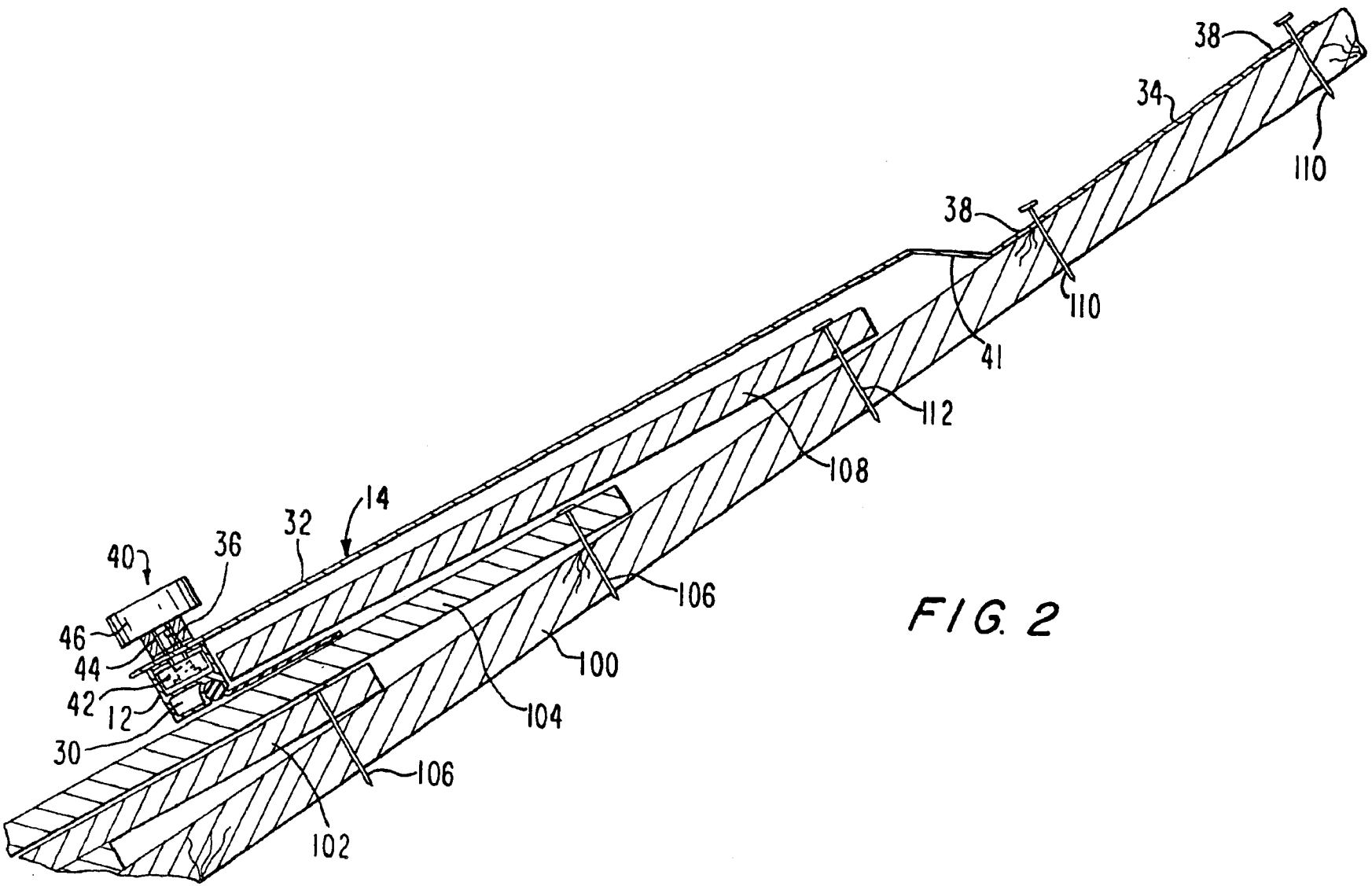
FIG. 2 shows a side-sectional view of the roofing tool being used to install tiles.
Figure 3:
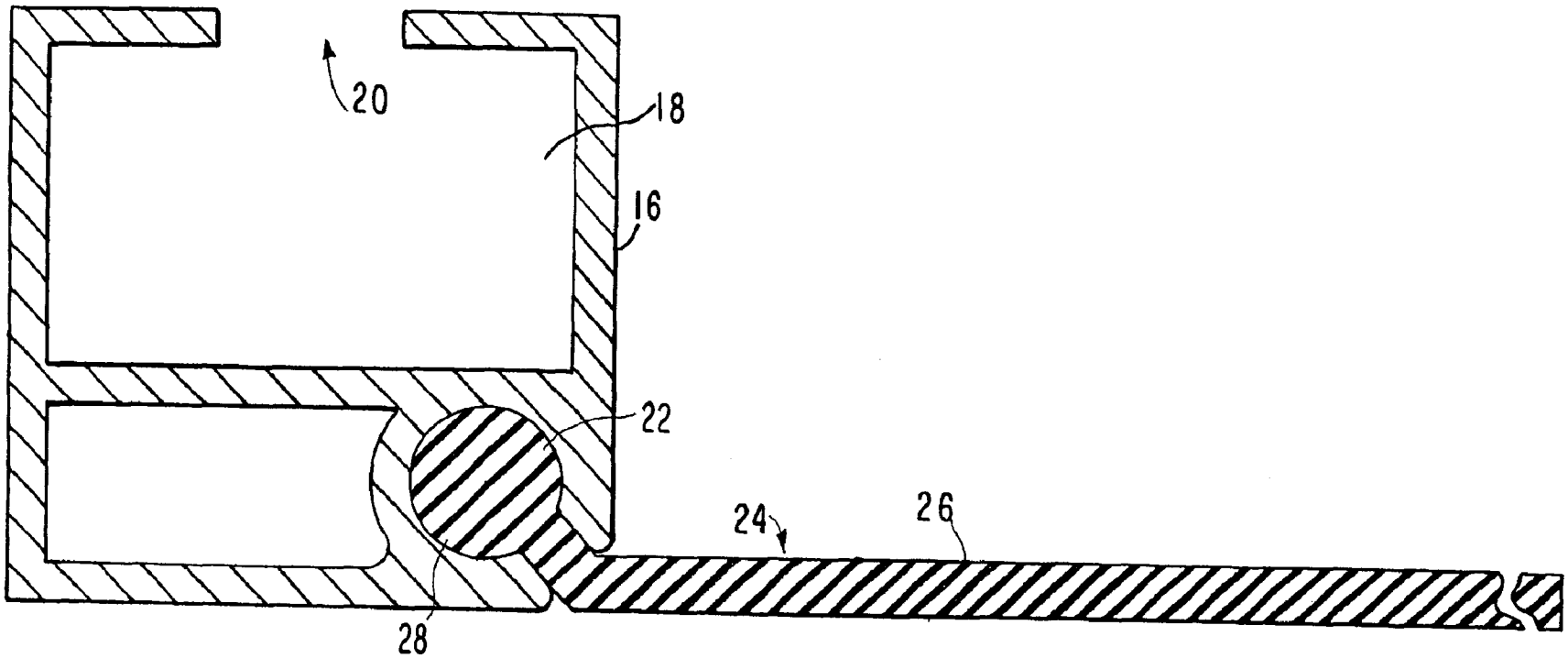
FIG. 3 shows an enlarged side sectional view of the rail of the tool.
Figure 4:
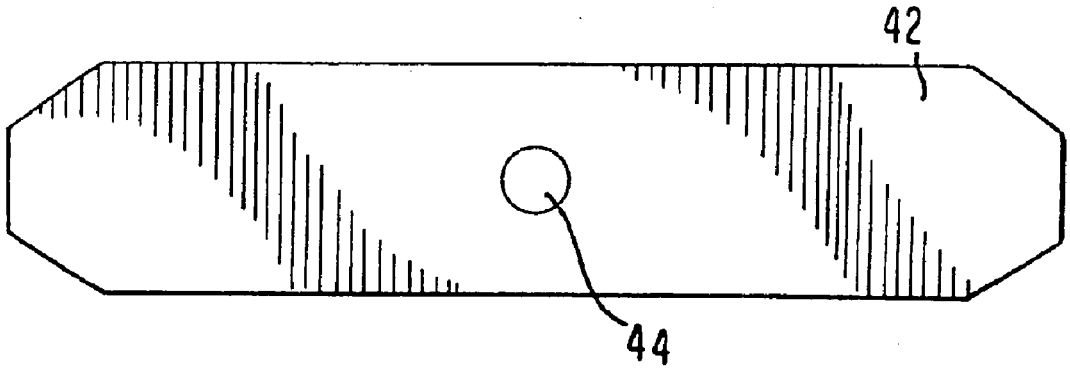
FIG. 4 shows a plan view of a slider for the roofing tool of FIG. 1.
Figure 5:
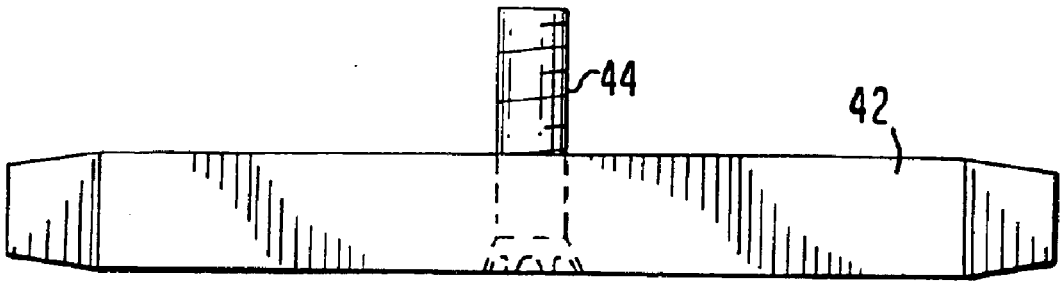
FIG. 5 shows a side elevational view of the slider of FIG. 4.

Arm 14 shown in detail in FIGS. 2. It is made of aluminum, steel or other similar material and it includes two straight portions: a lower portion 32 and an upper portion 34. The lower portion is formed at its end with a hole 36 for mounting arm 14 to the rail 12, as discussed in more detail below. The upper portion 34 is formed with one or two holes 38. The two portions 32, 34 are joined by an angled section 41. The arm 14 may be ½–¾ in wide and about ¼ in thick.

Each arm 14 is attached to the rail 12 by a knob 40. The knob includes a slider 42 (shown in detail in FIGS. 4 and 5) a screw 44 and a handle 46. The slider 42 is sized and shaped to fit into the passage 18. The screw 44 passes through a threaded hole (Not shown) in the slider 42 and extends through the slot 20. Its external end is fixed to the handle 46. When the knob 40 is loose, the arm 14 can be rotated about screw 44 as indicated by arrows A and B in FIG. 1. In this manner, the arms 14 can be folded to lie on top of rail 12. The knob 40 can be tightened while the arms are in this closed configuration so that the tool 10 can be lifted up easily to, or lowered easily down from the job site. In this configuration, the tool is also easy to transport. Alternatively, the arms 14 can also be pivoted to the open position in which they are extend perpendicularly to the rail 12. A detent may be formed on the lower portion 32 to engage a sidewall of the rail 12 in such a manner that when the arms 14 are opened all the way, the detent forces them to snap to the perpendicular orientation and stay in that position while the tool 10 is in use.

The installation of tiles on a roof using tool 10 is now described in conjunction with FIG. 2. Typically, the roof of a building, prior to tiling, consists of a wood deck 100. The process of roofing consists of installing several overlapping of tiles on the wood deck 100. In FIG. 2, two courses of tiles 102 and 104 has been installed and secured to the deck 100 by nails 106. Before the next course is laid, the tool 10 is positioned, as shown in the Figure, with the rail 12 resting on top of course 104 at the upper edge of the exposure. (The exposure is the portion of tiles of a course that is left exposed to view with the rest of the tiles being covered by the successive courses). The arms 14 are perpendicular to the rail 12 and extend past the upper edge of course 104. The arms 12 are secured to the deck 100 by temporary nails 110. The distance D between the rail 12 and the first nail 110 is approximately a full size tile plus 3–4 in. The web of the skirt 24 lies flat on top of course 104.

With the tool 10 in the position described, the tiles of the next course 108 are placed on top of course 106. The lower portion of each of these tiles rests on the web of the skirt 24, and against the rail, which thus forms a straight edge for the course. A workman places each tile in sequence along the rail 12 from left to right, or right to left until the course 108 is complete. The tiles are kept in place by the rail 12. When the whole (or a portion) of the course is complete, the workman secures the tiles to the deck 100 with nails 112. During this whole process, the workman does not have to hold the tiles in position since they are held and automatically aligned by the rail 12. The skirt 24 cushions the tiles to insure that they do not crack or chip.

The length of arm portion 32 is equal approximately to the length of the tiles forming the respective course plus 1 in, so that the tiles can be laid without interference with the arm. The arm portion 34 can be about 2 in longer than the exposure The two portions 32, 34 are offset by angled portion 41 by a distance sufficient to insure the clearance for the tiles. This offset between the two arm portions can be made smaller for thinner tiles (such as slate tiles) and larger for thicker tiles (such as wooden shingles).

Once the tiles of a course are secured, the tool 10 is separated from the deck 100, for example by removing the nails 110. The tool is then moved slightly downward to pull the skirt out from under the tiles of course 108, and the tool is placed with its ready for laying the next course.

As discussed above, preferably, the rail has a length of 4–8 feet for easy transportation and storing. Of course many roofs are much longer than that. For this purpose a composite roofing tool is used formed of two or more rails similar rail 12, each rail having its own a set of arms 14. For this purpose the rail 12 is provided at its ends with additional sliders 42A that extend out of the passage 18 and can be telescopically received by an adjacent rail 12 to insure that the rails are properly aligned with each other. The sliders 42A may be supported on one of the rails 12 by a knob 40A.

Figure 6:
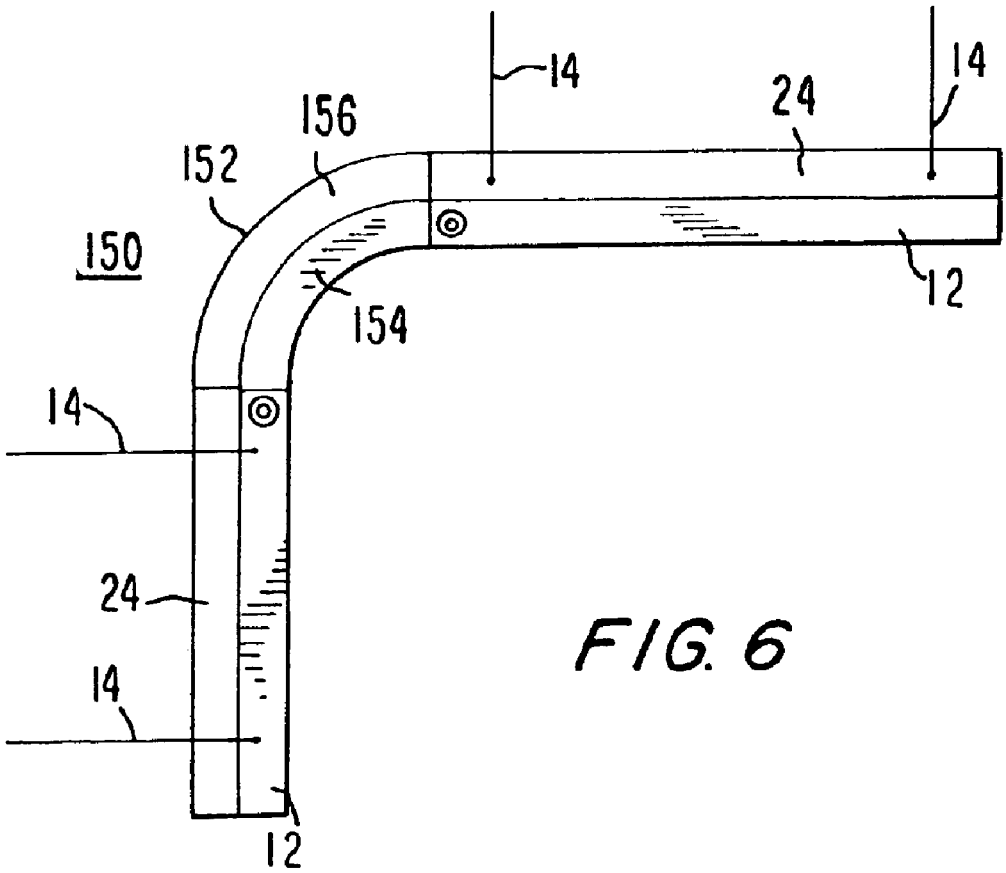
FIG. 6 shows a roofing tool with two straight section connected by a curved connector.
Figure 7:
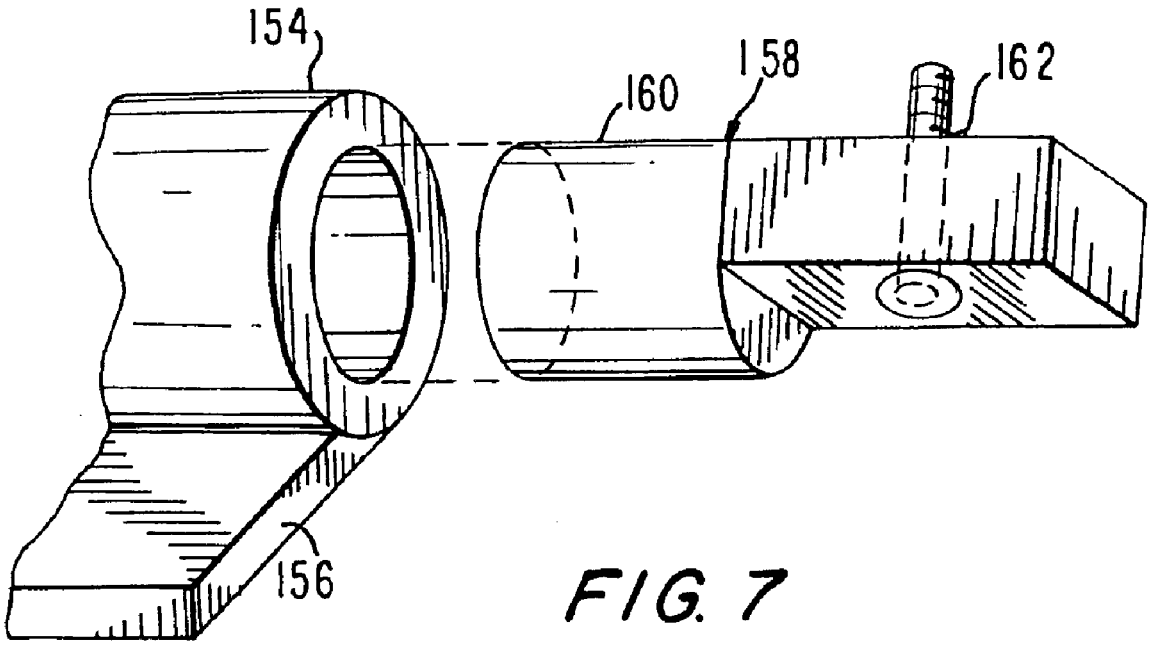
FIG. 7 shows an enlarged section of and of the curved connector of FIG. 6 with an insert.

Some houses have several roof sections which meet at respective angles. For these types of roofs a composite roofing tool 150 is used as indicated in FIG. 6. Tool 150 includes two rails 12, each having its arms 14 and skirt 24. A curved connector 152 is used to couple and align the two rails 12. The connector is formed with a flexible hollow tube 154 that can follow the curvature of a roof corner (not shown) and easily match its curvature. As seen in FIGS. 6 and 7, attached to the tube 154 is a curved adapter skirt 156. The connector 152 is also provided with an adapter 158 having two portions, a rod-shaped portion 160, and a straight portion 162, The rod-shaped portion 160 fits into the tube 154 while the straight portion 162 fits into the rail 12 in the same manner as slider 42, 42A. An adapter 158 is provided at each end of tube 154 for connection to a respective rail 12. The two portions 160, 162 are axially offset, as shown, to insure that the adapter skirt 156 is aligned with the skirts 24 of the two rails 12. The composite roofing tool 150 is used to lay courses across the roof sections, including the curved valley interconnecting the same, with the adapter 152 providing the alignment for the tiles at the valley.

Figure 8:
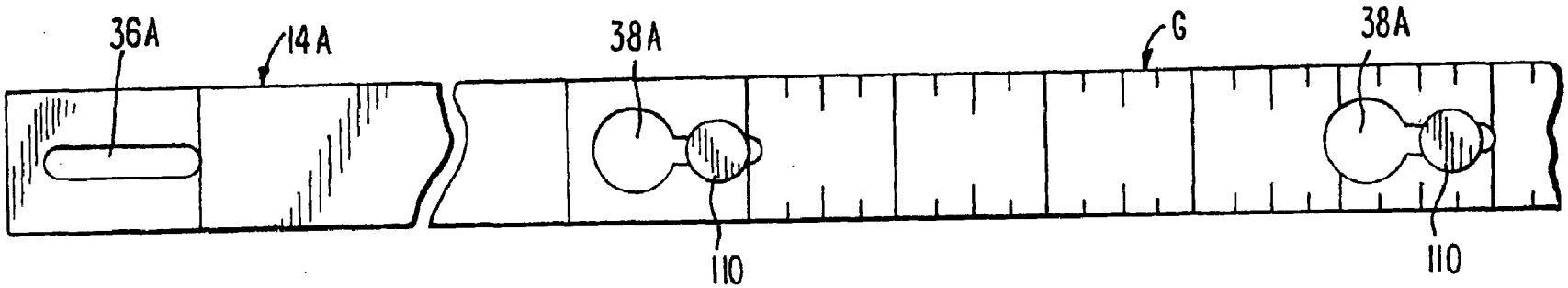
FIG. 8 shows a plan view of an alternate embodiment of an arm for the roofing tool.

In one alternate embodiment shown in FIG. 8, arm 14A is provided with an elongated hole 36A receiving screw 44 and elongated holes 38A at the other end. The holes 38A may have a keyhole shape, as shown. This configuration is advantageous because, once a respective course is laid, the arms can be shifted longitudinally upward to allow the arms 14A to be lifted off the nails 110 without the need for removing the nails 110 from the deck 100. The nails 110 can then be hit until they their heads are flush with the deck 100. Once the arms 14A are lifted off the nails, the rail 12 can be shifted downward to pull the skirt out from under course 108. The arms 14 may be provided with gradations, as at G which provide the roofer with guidance for marking the position of the next course. Typically, as the courses approach the peak of the roof, their exposure is lessened.

Figure 9A:
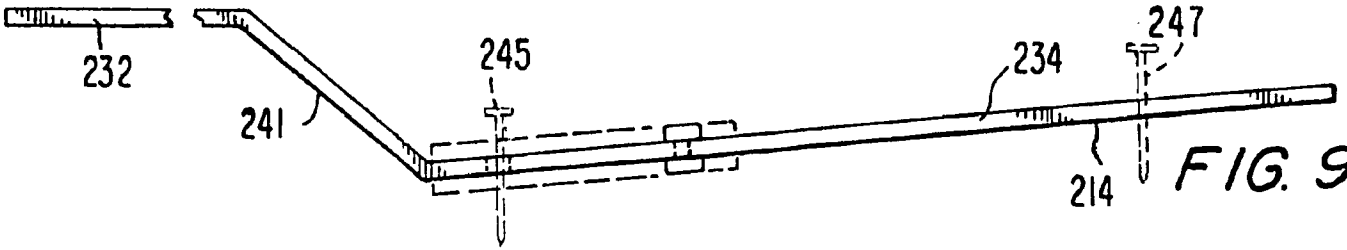
FIGS. 9A–9D show details of an alternate embodiment of an arm for the roofing tool.
Figure 9B:
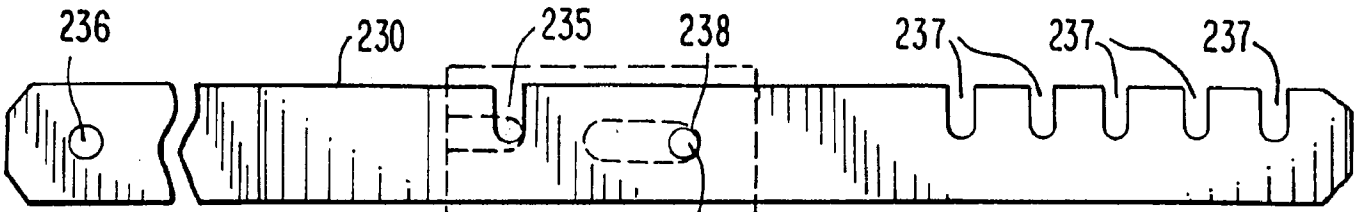
Figure 9D:
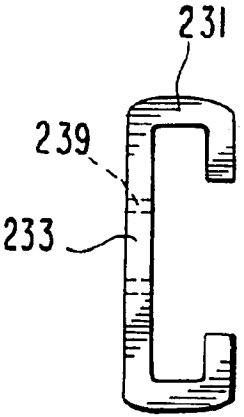
Figure 9C:
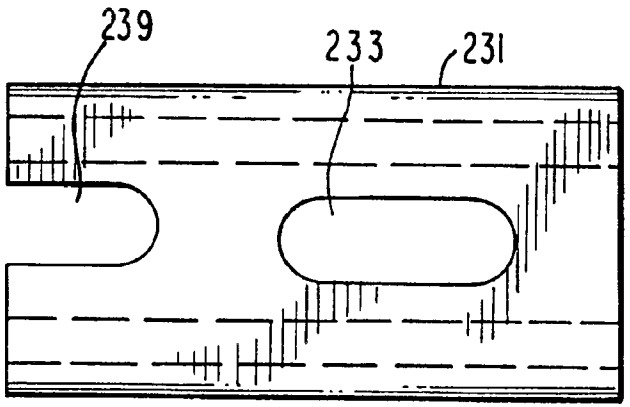

In a second alternate embodiment shown in FIGS. 9A–9D, an arm 214 is shown which includes two straight portions: a lower portion 232 and an upper portion 234. The lower portion is formed at its end with a hole 236 for mounting arm 214 to the rail 12, as discussed. The upper portion 234 is formed with a hole 238 and a lateral slot 235 disposed near hole 238. In addition, the distal end of the portion 234 is formed with a plurality of axially spaced lateral slots 237. The two portions 232, 234 portions are joined by an angled section 241 which may be flexible to compensate for tiles of various thicknesses. A sleeve 231 is also provided. As seen in FIG. 9D the sleeve may have a C-shaped cross-section, or may be tubular. The sleeve 213 is formed with an elongated hole 233 and a slot 239. The sleeve 231 is slidably connected to arm 230 by a rivet 243 or other means which passes through hole 233. Because of its shape, the hole 233 allows the sleeve 231 to slide longitudinally along the arm 230. The arm 230 is attached to a roof by two nails. One nail 245 passes through or is engaged by slot 235. The other nail 247 passes through one of the slots 237. Once the arm is attached to the roof, the sleeve 231 is moved down over the nail 245 to trap it and insure that the arm is not disengaged from the roof while the tiles are installed. Once a course is completed, the sleeve 231 is raised, and the arm is rotated slightly with respect to the base (not shown) to disengage it from the nails 245, 247. The slots 237 are spaced so that the arm can be used for tiles of different sizes, or to accommodate for the shorter exposure or in graduated roofs with larger exposure at the elves and smaller courses at the peak of the roof.

Figure 10A:
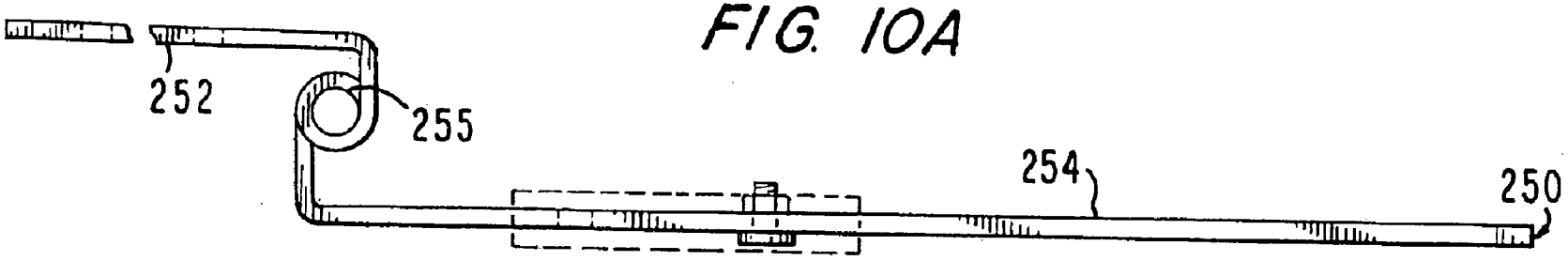
FIGS. 10A–10B show details of an embodiment of a hinged arm.
Figure 10B:
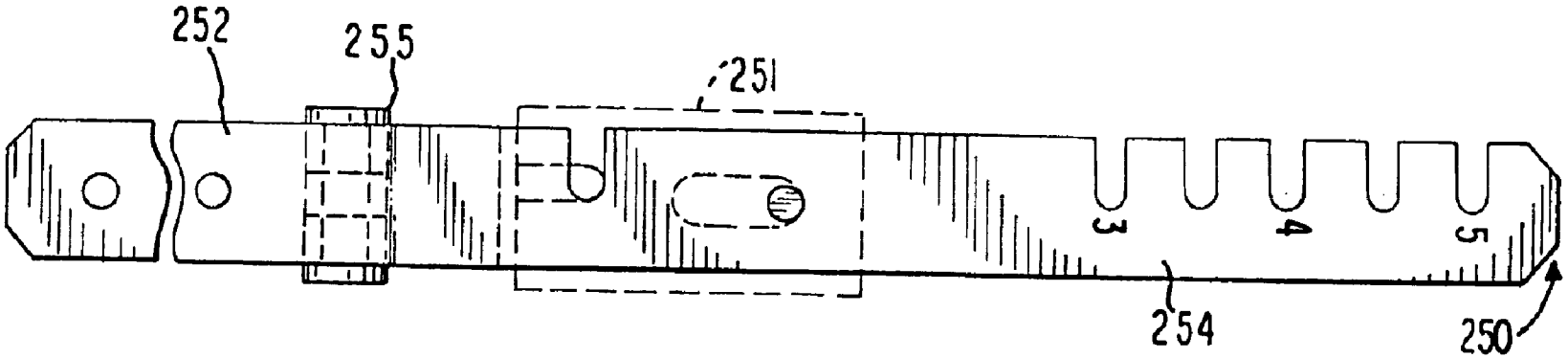

FIGS. 10A–10B show an arm 250 with two portions 252, 254 and a sleeve 251 similar to portions 232, 234 and sleeve 231 in FIGS. 9A–9D. In addition, the arm 250 also has a hinge 251 which allows the portion 254 to rotate by about 270° with respect to portion 252. This feature allows the arm 250 to be used on wider range of tiles.

FIGS. 11A–11G show another embodiment. In this embodiment, roofing tool 260 is formed of rail 12, skirt 264 and arm 266 attached to the rail 12 by a knob 268. A spring washer 262 is provided under the knob 268 to allow the knob 268 to be handled easier. The washer can be made of steel or a plastic material.

The arm 266 includes a first portion 270 and a second portion 272. The second portion 272 may be similar to the portions 234 and 254. In one configuration, the two portions are coupled to each other by a hinge 274 formed of a boss 276 and a pin 278.

Figures 11A, 11B, 11C, 11D, 11E, 11F:
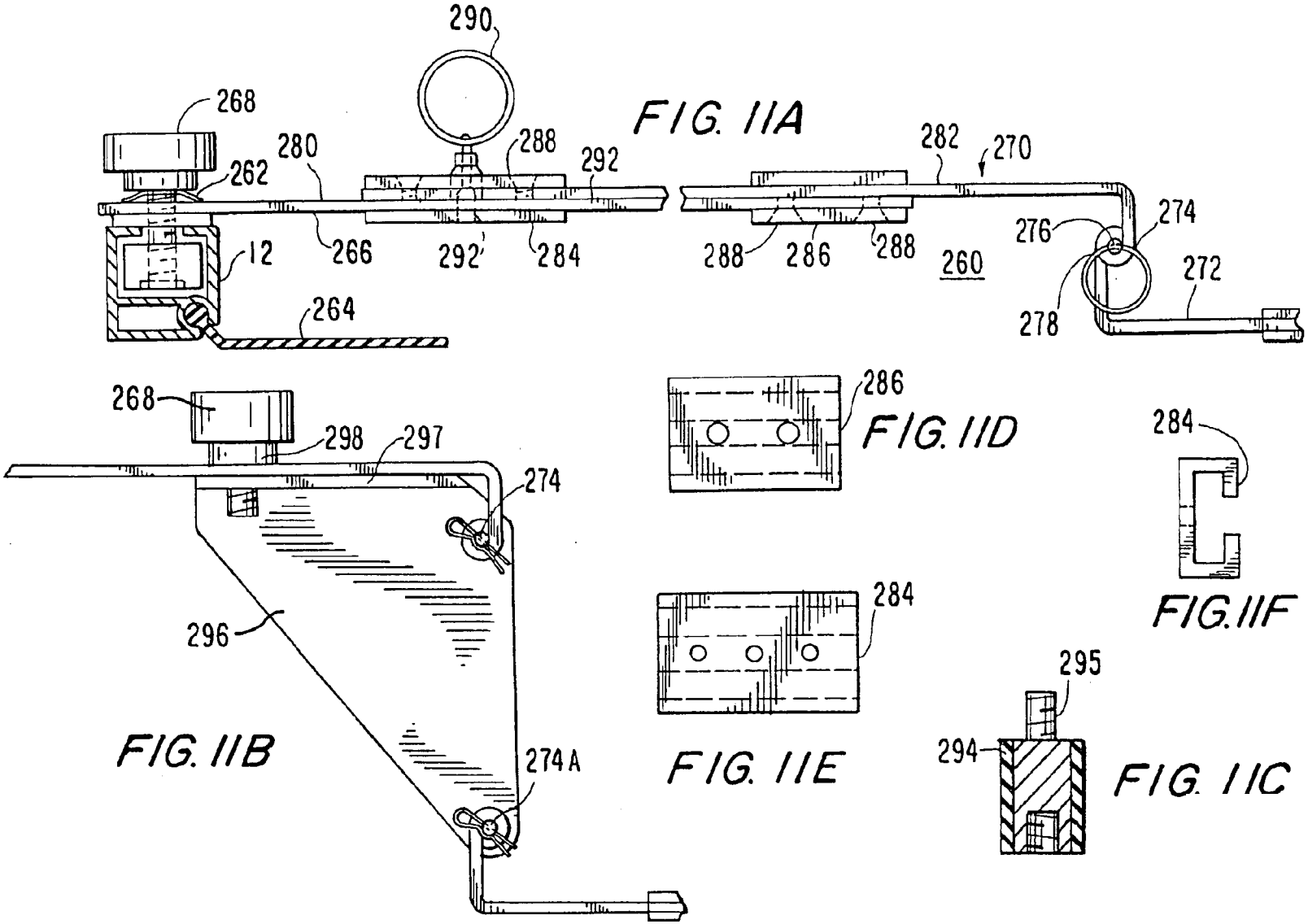
FIG. 11A–F show details of another embodiment of the invention with a hinged arm.

The portion 270 is formed of two bars 280 and 282. The two bars are held together with two sleeves 284, 286. Screws 288 in these sleeves are used to keep the arm steady and secure by insuring that there is minimal play between the bars. Sleeve 284 also has a spring loaded plunger 290. The plunger passes through one of several axially spaced holes 292 in the arms. The overall length of the portion 270 is adjusted by pulling the plunger 290 out, shifting the bars longitudinally with respect to each other until a new hole 292 is reached and then reseating the plunger 290 in the new hole. Importantly, the arm 266 may also be adjusted to extend further away from the rail 12. This is accomplished by providing a spacer sleeve 294 and a longer screw 296 for the handle 268, shown in FIG. 11G. In addition, the two portions 272, 274 are further separated by a triangular spacer 296. The spacer 296 is coupled to the portions 272 and 274 by hinges 274, 274A and has a flat part 297 that is used to further secure the spacer 296 to the portion 270 by a thumb screw 298, as shown in FIG. 11B.

Figures 12A, 12B, 12C, 12D, 12E:
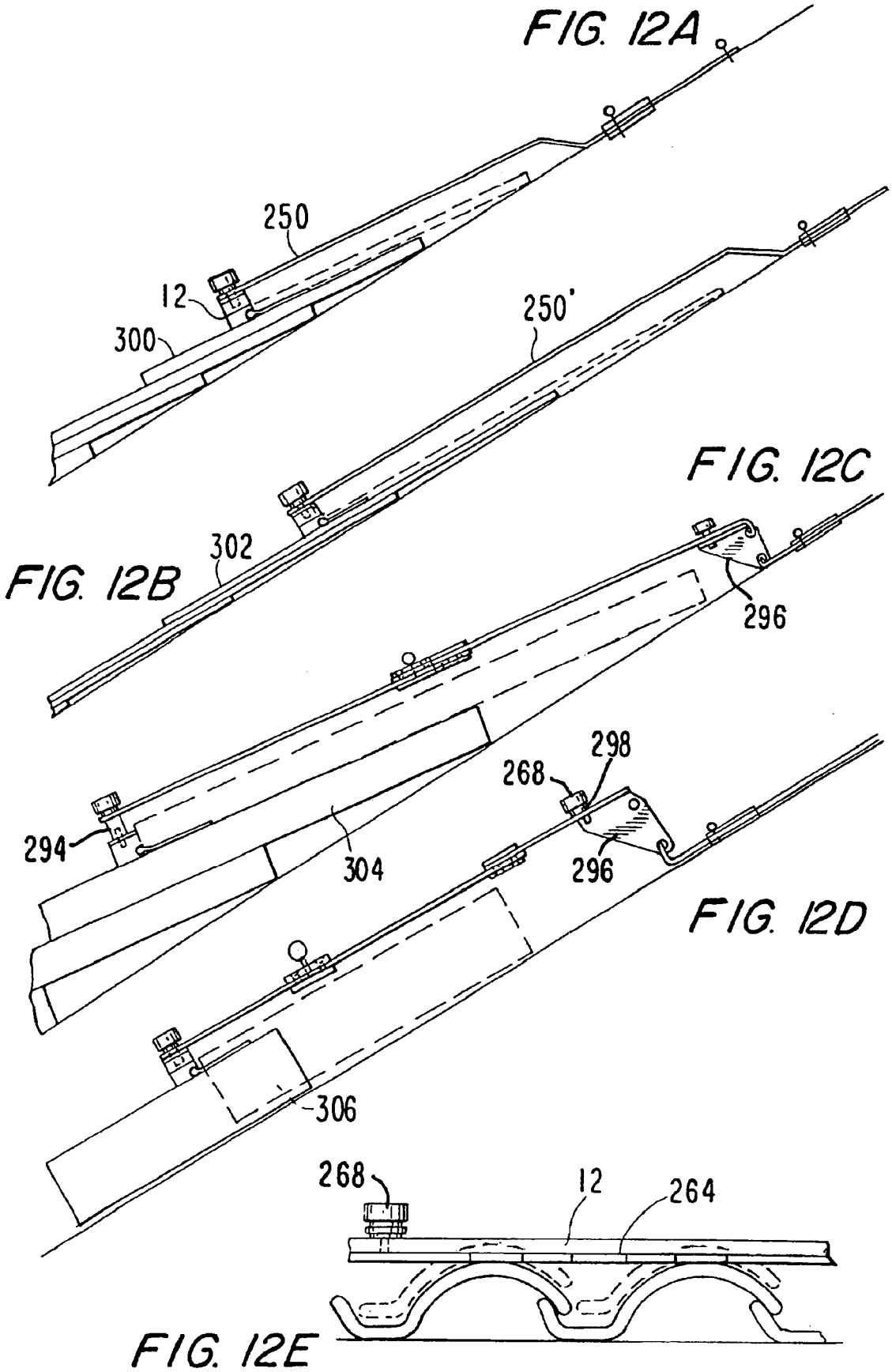
FIGS. 12A–E show side views of the various embodiments of the tool for installing various types of roofing materials.

An advantage of the tool described herein is that it can be used with the appropriate parts to install various types of roofing materials. For example, FIG. 12A show how the tool consisting of rail 12 and arm 250 is used to install tiles 300 that are ½" thick, 12" long and 5" exposure. FIG. 12B show the same rail 12 and a longer arm 250' (but essentially the same structure as arm 250) to install slate 302 that is ¼" thick, 18" long and 7½" exposure. FIG. 12C shows tool 260 used to install jumbo wood shakes 1½" thick, 24" long and 10" exposure. FIGS. 12D and 12E show the tool 260 for installing Spanish ceramic tiles having semi-circular shape, ½" thick, 13¼" long and 10¼" exposure. As shown in FIG. 12E, for this installation, the skirt 26 may be cut at regular intervals to accommodate the tiles, as shown.

Figure 13:
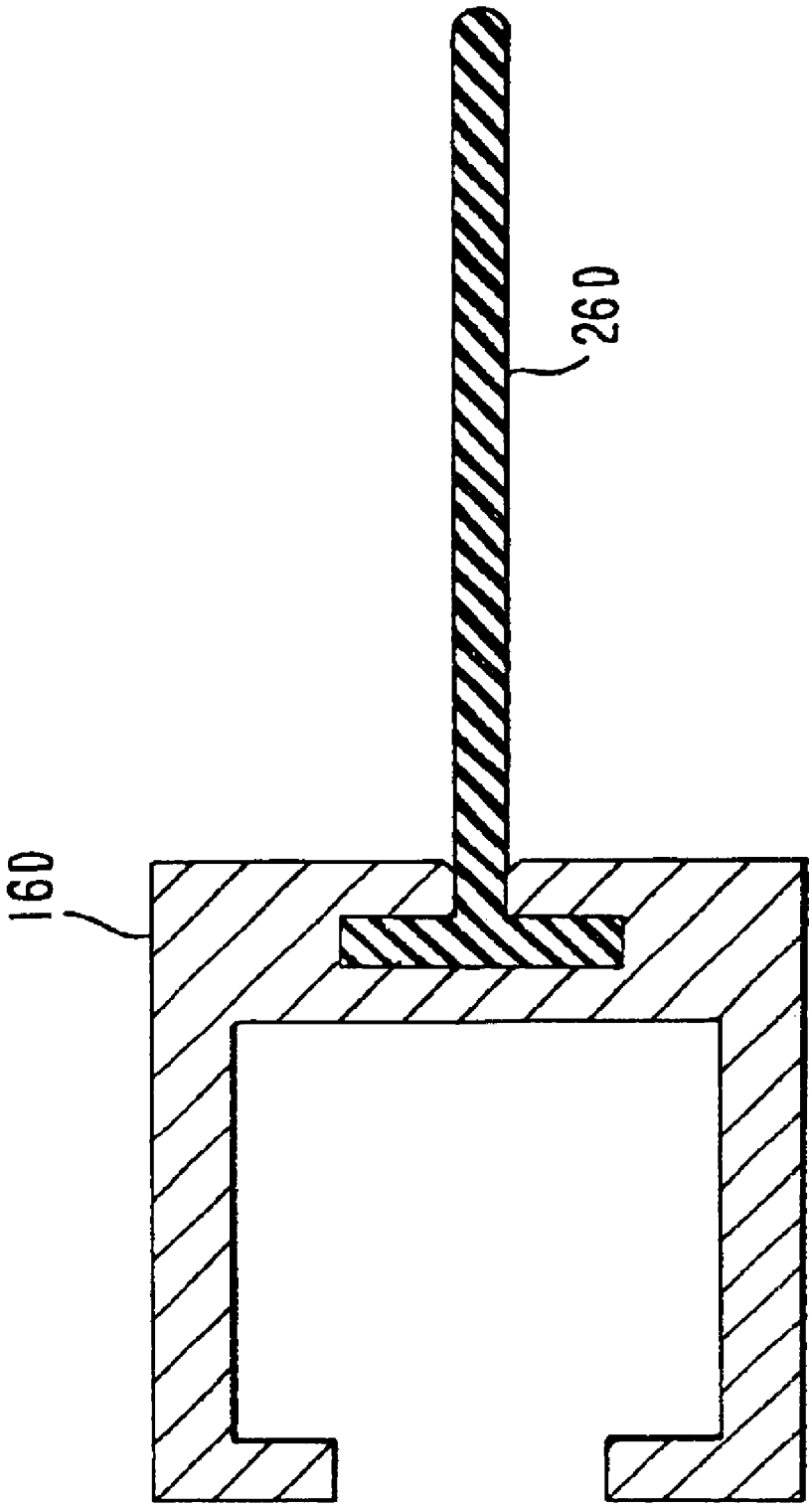
FIG. 13 shows a channel modified for the installation of high wind roofing or siding.

FIG. 13 shows a modified rail adapted to install high wind resistant roofing tiles or siding. The rail includes a channel 16D with a rubber attachment 26D extending outwardly as shown. In use the rubber attachment 26D supports the roofing or siding material before the latter is secured to the underlying base.

Figure 14:
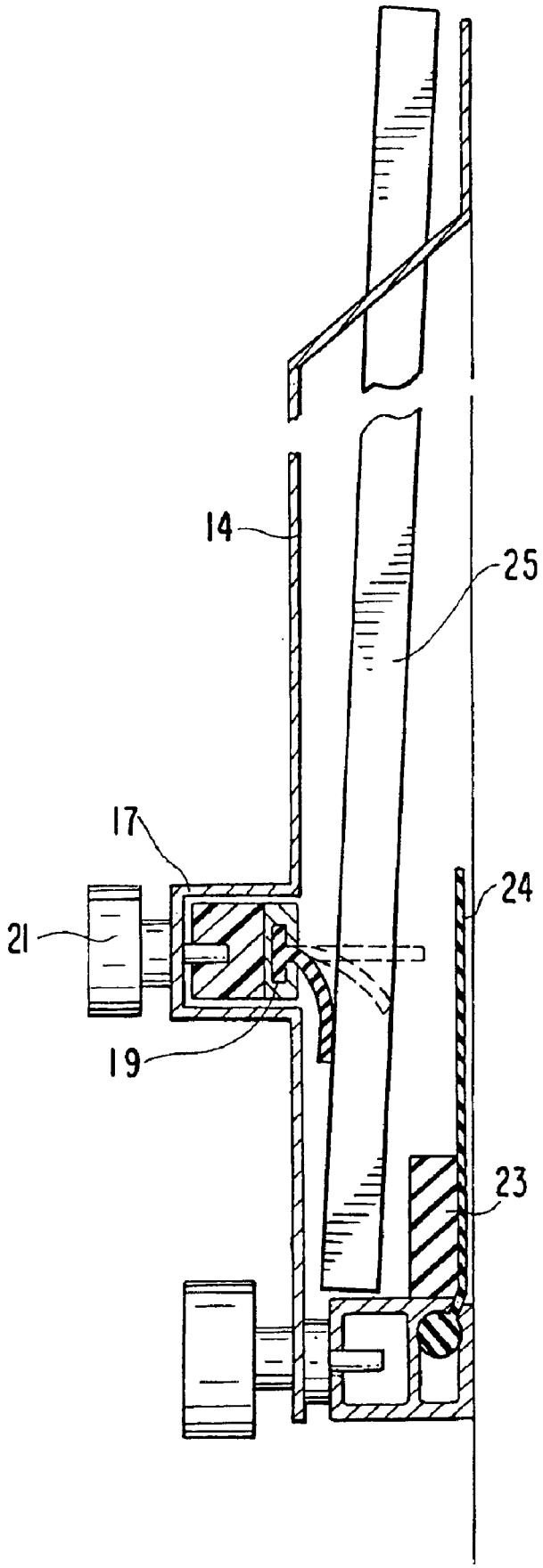
FIG. 14 shows modifications to the tool members for installing siding.

The tool and its various attachments and implements was described so far is particularly suited for installing roofing materials. However, the same tool may also be used for installing covering for the external walls of a structure, such as aluminum or other type of siding. As shown in FIG. 14 for this purpose, arm 14 is altered slightly to accommodate a horizontal elastic retainer 19 to support the siding. Alternatively, the retainer 19 can be replaced by a cord attached to the arms 14. As seen in FIG. 14, the retainer 19 is mounted on the arms 14 by a fastener 21. An additional spacer 23 is provided to hold the siding 25 in the correct position during installation.

The tool can be sold with a rail 12 and a set of arms 14, the arms having specific lengths and features for specific materials, as described. Alternatively, a tool kit can be sold that includes the rail 12, several types of arms 14, 250, 266, retainer 17, spacer 23, connectors, circular tubings, etc. Alternatively, these later components can be bought separately.

While the invention has been described with reference to several particular embodiments, it is to be understood that these embodiments are merely illustrative of the principles of the invention. Accordingly, the embodiments described in particular should be considered as exemplary, not limiting, with respect to the following claims.

I claim:

1. A tool kit for installing several types of tiles in courses on a roof including a first roof section and a second roof section, said roof sections meeting at an angle to form a valley, said kit comprising:

a plurality of sets of arms, each set of arms being sized to fit over a corresponding type of tile:

first and second rails adapted to define respective straight edges for said courses;

a plurality of knobs for coupling one of said sets of arms to said rail in a spaced relation along said rail, said rail and said one of said sets of arms cooperating to position said rail along a previous course of tiles and to define a straight edge for a present course of tiles with said arms extending from said rail, over said present course of tiles and terminating with an end just beyond said present course of tiles said termination being secured to the roof or sidewall; and a flexible connector for connecting said rails at an angle to each other.

* * * * *